US006024549A

United States Patent [19]

Lee

[11] Patent Number: 6,024,549

[45] Date of Patent: Feb. 15, 2000

[54] VANE TYPE ROTARY DEVICE

[76] Inventor: Charles Matthew Lee, 837 Spence Cir., Virginia Beach, Va. 23462

[21] Appl. No.: 09/306,215

[22] Filed: May 6, 1999

[51] Int. Cl.[7] ..... F01C 1/00; F01C 19/08

[52] U.S. Cl. ..... 418/135; 418/256

[58] Field of Search ..... 123/204; 418/130, 418/135, 147, 148, 256, 260

[56] References Cited

U.S. PATENT DOCUMENTS

| | | | |
|---|---|---|---|
| 2,414,187 | 1/1947 | Borsting | 418/256 |
| 2,590,132 | 3/1952 | Scognamillo | 418/148 |
| 3,360,192 | 12/1967 | Van Hees | 418/256 |
| 5,568,796 | 10/1996 | Palmer | 123/204 |
| 5,709,188 | 1/1998 | Al-Qutub | 123/204 |

FOREIGN PATENT DOCUMENTS

| | | | |
|---|---|---|---|
| 136385 | 11/1947 | Australia | 418/135 |
| 753431 | 8/1933 | France | 418/256 |
| 63-9685 | 1/1988 | Japan | 418/256 |
| 114584 | 4/1918 | United Kingdom | 418/256 |
| 677569 | 8/1952 | United Kingdom | 418/256 |

*Primary Examiner*—Michael Koczo

[57] ABSTRACT

A rotational mechanism which consists of a circular armature fitted with a plurality of radial vanes which rotates within a stationary, cylindrical, containment structure with a circular bore. The rotational armature is concentrically installed on a rotational shaft which passes through the axial ends of the containment structure and which is supported by low friction rotational bearings such as to rotate on an axis which is parallel to, but radially separated from, the axis of the containment cylinder. The axial ends of the shaft provide the interface with external mechanically dynamic systems. The armature is a hollow cylinder which incorporates a plurality of uniformly distributed radial slots each of which extends through the annulus. The axial slots are each sized such as to provide annular support for a radial vane but allow relative sliding movement of the vane in axial and radial directions. The radial vanes are radially and axially constrained at each end such by means a rotating vane end constraint assemblies. The vane end constraint assemblies are supported by low friction rotational bearings such as to rotate on an axis which is concentric with the axis of the containment cylinder. The vane end constraint assemblies each consist of a disk with an axially extended rim, an axial compression spring, and a wear ring. The axially extended rim of the said disk radially constrains each vane such that the outermost peripheral edge of the vane is in close proximity to, but not in contact with, the inside surface of the containment cylinder. The cavity formed by the axial face and the axially extended rim of the disk accommodates the axial spring and the wear ring.

1 Claim, 5 Drawing Sheets

VANE TYPE ROTARY DEVICE

BACKGROUND OF THE INVENTION

At the present time, machines employed for the production of mechanical energy by means of the expansion of compressed vapor or gas consist, primarily, of reciprocating engines and turbines. Reciprocating engines, often called "positive displacement" engines, employ the reciprocating motion of pistons and other mechanical components to accomplish the energy conversion process. In comparison, turbines are purely rotational machines which employ aerofoil-like lifting surfaces installed on a rotational armature to accomplish the energy conversion process. Both of these machines may feature the use of either externally produced or internally produced compressed gaseous or vaporous working fluid. Present day versions of these machines derived from early steam engine technology, the reciprocating engine from the inventions of Thomas Newcomen (1711), and James Watt (1763), and the turbine from the inventions of Dr. Gustav De Laval (1883) and Charles Parsons (1884). Over the last two centuries the basic products of these inventors have been developed to provide a range of prime power machines based upon a number of theoretical thermodynamic cycles such as stated by Carnot (1824), Rankine (1849), Breyton (1874), Otto (1876), and Diesel (1892).

In a general comparison reciprocating machines offers good control response and is favored for low to moderate (fractional horsepower to 5000 horsepower) power systems requiring rapid response to a wide range of power demands. However, their functional dependency upon reciprocating motion and mechanically actuated valve arrangements constrains the power density of these machines causes them to inherently feature undesirable characteristics of noise and vibration. The turbine offers the advantages of reduced mechanical complexity, superior power density and vibration free operation. However the power density of the turbine is substantially derived from its relatively high rotational speed and, therefore, turbines require transmission gearing systems with large reduction ratios to make them mechanically acceptable prime movers for most applications. The economic and inertial implications of this requirement is substantially the reason that turbine machinery is commonly preferred only for applications requiring a relatively steady state demand for large measures of power (500 horsepower to 50,000 horsepower).

Over a number of years significant inventive effort has been directed toward the derivation of "rotary" machines which would offer the performance and operational flexibility characteristics offered by reciprocating type machines without their attendant characteristics of mechanically produced noise and vibration. Patents granted for rotary energy conversion machines feature a variety of motion principles and rotational component concepts such as intermeshing and eccentrically rotating lobe type rotors, intermeshing gear type rotors, and radial vane (blade) type rotors. The invention presented in this disclosure is related to a radial vane type rotary machine as briefly described below.

The radial vane type rotary machine primarily consists of a stationary containment cylinder with a closure structure affixed at each end which enclose a rotational armature rigidly installed on a rotational shaft. The interior surface (bore) of the stationary containment cylinder is circular in cross section and cylinder wall is installed with ports such as to permit the movement of the working fluids, through its boundary at appropriate locations. The axial ends of the rotational shaft pass through rotational bearings installed in the containment cylinder end closure structures and are configured such as to provide the appropriate interfaces for imparting or extracting rotational energy from the device. The rotational shaft and armature are concentric and rotate on an axis which is parallel to, but radially displaced from, the axis of the containment cylinder. The armature is circular in cross section with a diameter significantly less than the bore diameter of the containment cylinder and is fitted with a number of equally spaced radial slots each of which is parallel to the axis of the armature. The slots are sized such as to provide structural support for a radial vane but allow relative sliding movement of the vane in axial and radial directions. The vanes project from the periphery of the armature such as to maintain contact with or remain in close proximity to the inside surface of the containment cylinder. The presence of the radial vanes subdivides the cavity between the peripheral surface of the armature and the inside surface of the containment cylinder into a number of segmental, annular, cells. Each cell is bounded by the armature periphery, the interior surface of the containment cylinder, two adjacent radial vanes, and the containment cylinder end structures. The radial displacement of the rotational axis of the armature from the longitudinal axis of the containment cylinder causes the radial distance between a reference point on the peripheral surface of the armature and the interior surface of the containment cylinder to be trigonometrically dependent upon the rotational position of the armature. This trigonometric dependency causes a cyclical variation the volume of any given segmental cell as the armature is rotated. The cyclical variation in segmental cell volume resulting from armature rotation fulfills the volumetric change requirements of Rankine and Carnot heat engine cycles. For any given cylinder length, the effective (swept) volume is directly related to: a) the difference between the inside diameter of the containment cylinder and the rotating armature, and b) the distance of separation between the longitudinal axis of the containment cylinder and the rotational axis of the armature. For any given effective volume, the compression (or expansion) ratio of the volumetric cycle is directly related to the number of segmental cells surrounding the armature.

The functional viability of all fluid compression machines is fundamentally dependent upon their capability to exceed thresholds for thermodynamic and mechanical efficiency while fulfilling particular requirements for effective fluid containment and the accommodation of thermally and/or mechanically induced structural deformations. In this regard radial vane type rotary machines introduce a number of issues each which requires careful consideration in the development of a functionally viable entity.

The thermodynamic efficiency of all fluid compression machines is directly related to the compression (or expansion) ratio of the volumetric cycle, and, as previously noted, the said ratio is directly related to the plurality of the segmental cells surrounding the armature. For this reason from a thermodynamic efficiency viewpoint, the functional viability of the radial vane machine is attained only when the plurality of radial vanes exceeds a certain minimum threshold.

Mechanical efficiency is essentially the measure of energy conservation exhibited by a mechanism in the process of doing work and, substantially, relates inversely to the quantity of energy dissipated by frictional interaction of dynamically related components. From a mechanical efficiency viewpoint functional viability is attained only when the relative magnitude of energy dissipation is less than a certain allowable threshold.

One unique mechanical efficiency problem presented by radial vane type rotary machines is the means for restraint of the radial vanes which, in the plurality necessary to satisfy thermodynamic efficiency requirements, create the preponderance of dynamically active mechanical interfaces. Early prior art for vane type rotary machine simply illustrates the radial vanes to be radially constrained by sliding or rolling contact between the radial vane and the containment cylinder or cam surfaces. Analysis demonstrates that the energy dissipation resulting from the combination of relatively large centripetal force and high relative speed makes such concepts non-viable from a mechanical efficiency viewpoint. Later art, as presented in recently awarded patents, illustrates methods for constraining the radial vanes by means of rotational vane end constraint devices which offer substantial improvement in mechanical efficiency.

The rotary vane machine also presents a unique problem in the need for a mechanically efficient means for effective gas sealing at the axial ends of the segmental cavities which surround the armature. The technical approach to the resolution of this issue as presented in prior art has essentially consisted of the incorporation of a minimized gap between axial ends of the rotating components and the inside surfaces of the containment cylinder end structures or radial vane constraint devices. Although this approach may be deemed technically viable for small radial vane rotary type liquid transfer pumps and compressed air driven motors the approach is deemed non viable for larger radial vane type rotary machines intended to function with high values of fluid temperature and pressure in which non uniform distributions in thermal and pressure loading may cause mechanically significant dimensional changes in the machine components. A device which offers the capability for maintaining an effective seal at the axial ends of the segmental cavities while elastically responding to thermally and mechanically induced dimensional changes in the machine components is the subject of this disclosure.

A number of cases of prior art as particularly related to the instant disclosure are briefly reviewed below:

U.K. Pat. No. 114,584 issued to Frank Lyon on Apr. 18, 1918 discloses a means by which the vanes are radially constrained by flanges on a pair of rotating disks one of which is installed, on low friction rotational bearings, at each end of the containment cylinder. Sealing at the ends of the segmental cavities is accomplished by contact between the inside surface of the disk and the ends of the rotating vanes and rotating armature. No means is provided to account for variations in the axial lengths of the interfacing components due to thermal expansion or other causes.

Republic of France Pat. No. 753.431 issued to M. Bernhard Bischof on Oct. 16, 1933 discloses a means by which each radial vane is radially constrained by a pair of shoe like components one of which is installed at each of the axial extremities of the vane and which slide upon a lubricated bearing ring installed at each end of the containment cylinder. The axial ends of the vanes maintain sliding contact with the inside faces of the containment cylinder end structures and no means is provided to account for variations in the axial lengths of the interfacing components due to thermal expansion or other causes.

U.S. Pat. No. 2,414,187 issued to Erling Borsting on Jan.14, 1947 discloses a means by which each radial vane is radially constrained by a pair of shoe like components, one of which is installed at each of the axial extremities of the vane, which bear upon the rim flanges of a pair of rotating disks one of which is installed, on low friction rotational bearings, at each end of the containment cylinder. Sealing at the ends of the segmental cavities is accomplished by contact between the inside surface of the disk and the ends of the radial vanes and the rotating armature. No means is provided to account for variations in the axial lengths of the interfacing components due to thermal expansion or other causes.

Commonwealth of Australia Pat. No. 136,185 issued to Sydney Edgar Willet et.al on Feb. 16, 1950 discloses a means by which the vanes are radially constrained by sliding contact with the inside surface of the containment cylinder. Sealing at the ends of the segmental cavities is accomplished by sliding contact between the ends of the radial vanes and the rotating armature and the inside surfaces of a pair of non rotating disks one of which is installed at each end of the containment cylinder. The disks are spring loaded to such as to account for variations in the axial lengths of the radial vanes due to thermal expansion or other causes.

U.S. Pat. No. 2,590,132 issued to F. Scognamillo on Mar. 25, 1952 discloses a means by which the radial vanes are radially constrained by a pair cylindrical extensions one of which is installed at each of the axial extremities of each vane and which engages a socket installed in a rotating disk at each end of the containment cylinder. No means is provided to account for variations in the axial lengths of the interfacing components due to thermal expansion or other causes.

U.K. Pat. No. 577,569 issued to John Meradith Rubary on Aug. 20, 1952 discloses a means by which the vanes are radially constrained by flanges on a pair of rotating disks one of which is installed, on low friction rotational bearings, at each end of the containment cylinder. Sealing at the ends of the segmental cavities is accomplished by contact between the inside surface of the disk and the ends of the radial vanes and the rotating armature. No means is provided to account for variations in the axial lengths of the interfacing components due to thermal expansion or other causes.

U.S. Pat. No. 3,360.192 issued to Adrian Van Hees on Dec. 26, 1967 discloses a means by which the vanes are radially constrained by flanges on a pair of rotating disks one of which is installed, on low friction rotational bearings, at each end of the containment cylinder. Sealing at the ends of the segmental cavities is accomplished by contact between the inside surface of the disk and the ends of the rotating vanes and rotating armature. No means is provided to account for variations in the axial lengths of the interfacing components due to thermal expansion or other causes.

Japanese Pat. No. 63-9685 issued to Nippon Piston Ring Co. Ltd. (Yukio Suzuki) on Jan. 16, 1988 discloses a means by which the radial vanes are radially constrained by flanges on a pair of rotating disks one of which is installed, on low friction rotational bearings, at each end of the containment cylinder. Sealing at the ends of the segmental cavities is accomplished by contact between the inside surface of the disk and the ends of the radial vanes and the rotating armature. No means is provided to account for variations in the axial lengths of the interfacing components due to thermal expansion or other causes.

None of the disclosures taken singly or combination describe the invention as claimed in this disclosure.

BRIEF SUMMARY OF THE INVENTION

The mechanism is imbedded in a rotary machine which, primarily, consists of a stationary containment cylinder, two stationary closure structures one of which is installed on each end of the containment cylinder, and two rotational assemblies contained within the stationary containment cylinder. The interior surface (bore) of the containment cylinder is circular in cross section and the containment cylinder is installed with ports to permit the movement of the working fluids, through its boundary at appropriate locations. One rotational assembly consists of a hollow circular armature which is rigidly and concentrically installed on a rotational armature support shaft. The ends of the rotational armature support shaft passes through low-friction rotational bearings installed the containment cylinder end closure structures and are configured such as to provide the appropriate interface for rotational mechanical energy. The rotational shaft and armature rotate on an axis which is parallel to, but radially displaced from, the axis of the containment cylinder. The rotational armature features a plurality of radial slots uniformly distributed around its periphery and axially parallel to the axis of rotation. The slots are uniformly sized such that each slot provides annular support for one radial vane with minimum clearance allow relative sliding movement of the vane in axial and radial directions The other rotational assembly consists of a plurality of radially arranged vanes (or blades), one of which is installed in each of the radial slots provided by the rotational armature, and a pair of radial vane constraining devices one of which is installed at each axial end of the rotational assembly. Each radial vane constraining device is supported by a low-friction rotational bearing installed in one the containment cylinder end closure structures. Said bearings are arranged such that the rotational axis of the assembly consisting of the radial vanes and radial vane constraining devices is concentric with the bore axis of the containment cylinder. Each radial vane constraining device is an integrated subassembly consisting of a radial vane radial constraint disk, an annular axial compression spring, a wear ring, and a plurality sliding shoe-like components. The radial constraint disk is circular with a diameter approximately equal to but less than the diameter of bore of the containment cylinder. The center of the radial constraint disk features a circular axial protrusion with the direction, diameter and length such as to interface with the appropriate low friction rotational bearing installed in the containment cylinder end structure and a circular opening of sufficient diameter to allow passage of the rotational armature support shaft without interference. The rim of the radial constraint disk features a flange which axially protrudes from the face of the disk in the direction of the rotational armature and which is provided with the thickness necessary to withstand the mechanical loads produced by high speed rotation and the axial length necessary to accommodate the other components of the radial vane constraining device. The wear ring is circular with a diameter closely equal to but slightly less than the inside diameter of the peripheral flange on the radial constraint disk and is installed in the cavity bounded by the face and the peripheral flange of the radial constraint disk. The rim of the wear ring features a flange which axially protrudes from the face of the wear ring in the direction of the radial constraint disk and which is provided with the length and thickness necessary to ensure vibration free axial sliding motion of the wear ring under conditions of high speed rotation. The center of the wear features a circular opening of sufficient diameter to allow passage of the rotational armature support shaft without interference and a flange which axially protrudes from the face of the wear ring in the direction of the radial constraint disk and which is provided with the length and thickness necessary to ensure the necessary structural rigidity of the wear ring. It is anticipated that the wear ring shall preferably be constructed from graphite or high strength, high temperature resistant, and wear resistant, ceramic material. The annular axial compression spring is installed in the cavity created between the face and flanges of the wear ring and the face of the radial constraint disk. The annular axial compression spring is sized such as to maintain an approximately constant, elastically applied, axial compression load between the face of the wear ring and the axial ends of both the rotational armature and radial vanes through the range of structural deformations as caused by thermal and mechanical loading resulting from machine operation. The peripheral end of each radial vane is engaged in a shoe like component which bears upon the inside of the rim flange of one radial constraint disk such that a micrometric distance of separation is maintained between the peripheral edge of the radial vane and the interior surface of the containment cylinder.

BRIEF DESCRIPTION OF THE VARIOUS VIEWS OF THE DRAWING

The drawing illustrates the embodiment of the device in a vane-type, rotary engine intended to be driven by steam or other pressurized, gaseous, working fluid provided from an external source. The drawing is presented in six pages and consists of a total of twenty illustrations as briefly described below FIG. 1 is a side elevation which illustrates the external general assembly. For purposes of orientation the power take-off flange is shown to the left of this illustration and the axis of rotation is horizontal.

Figure 9:
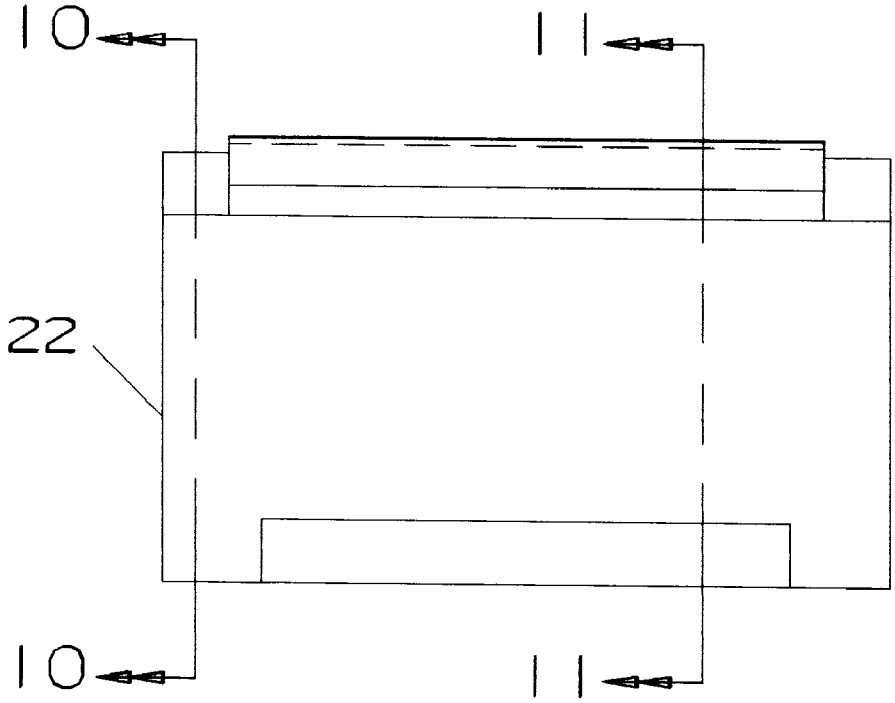
Figure 10:
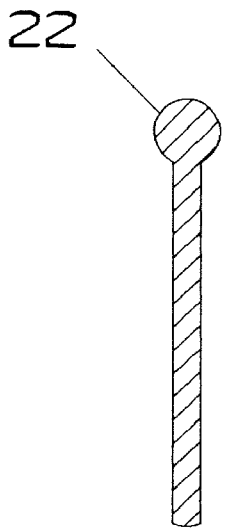
Figure 11:
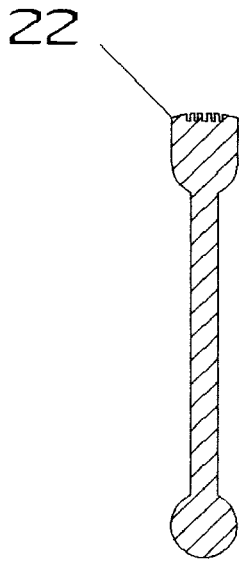

FIG. 9, FIG. 10, and FIG. 11 illustrate the principal geometric features of a typical radial vane.

DETAILED DESCRIPTION OF THE INVENTION

For the purposes of this disclosure the device is embodied in a vane-type, rotary engine intended to be driven by steam or other pressurized, gaseous, working fluid supplied from an external source. The device is deemed equally applicable to vane-type, rotary engines intended to be driven by pressurized gaseous, working fluid produced by internal combustion and to vane-type, rotary gas and vapor compressors.

Figure 1:
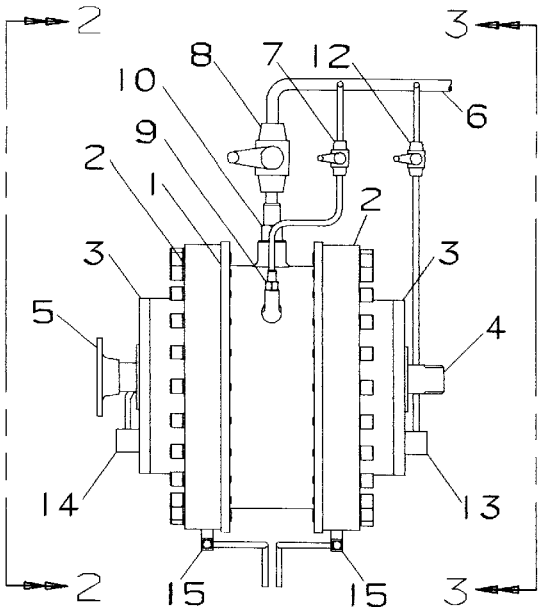
Figure 2:
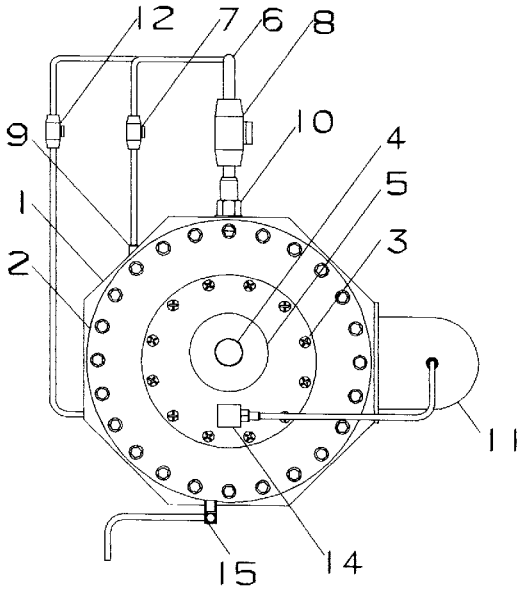
FIG. 2 and FIG. 3 are views of the right hand end and left hand end of the external assembly, taken along lines 2—2 and 3—3.
Figure 3:
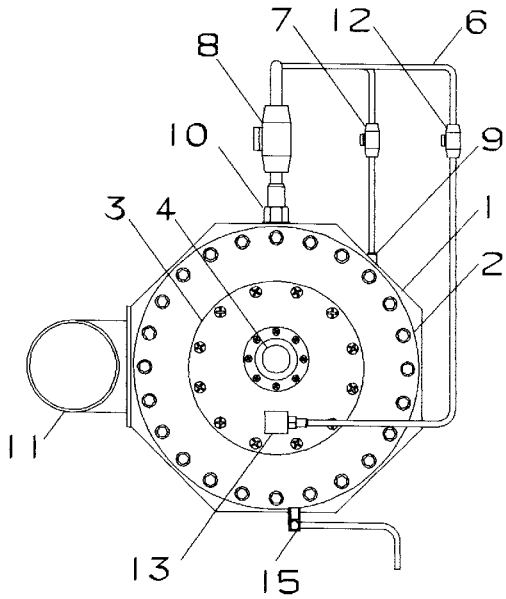

FIG. 1, FIG. 2, and FIG. 3, illustrate the general external assembly of the external combustion, vane-type, rotary engine together with the ancillary systems and system components necessary for continuous system operation. The containment cylinder (1), the containment cylinder end structures (2), and the rotational shaft bearing carrier (3) are the principal stationary foundation structures which functionally and physically support the dynamic components.

The rotational shaft (4) provides the means by which rotational power is extracted from the device and is illustrated as interfacing with a power take-off flange coupling (5) on one end. Pressurized vaporous or gaseous working fluid is delivered to the engine by means of the working fluid supply manifold (6). The components of the working fluid supply system consist of the engine start control valve (7), main control valve (8), engine start injector (9) and main injector (10). Expanded working fluid passes through the discharge port to an exhaust manifold (11). An ancillary system delivers working fluid for controlling the internal temperature and consists of an internal vent supply valve (12), internal vent supply port (13) and the internal vent discharge port (14). A condensate drain (15) is installed in each containment cylinder end structure (2).

Figure 4:
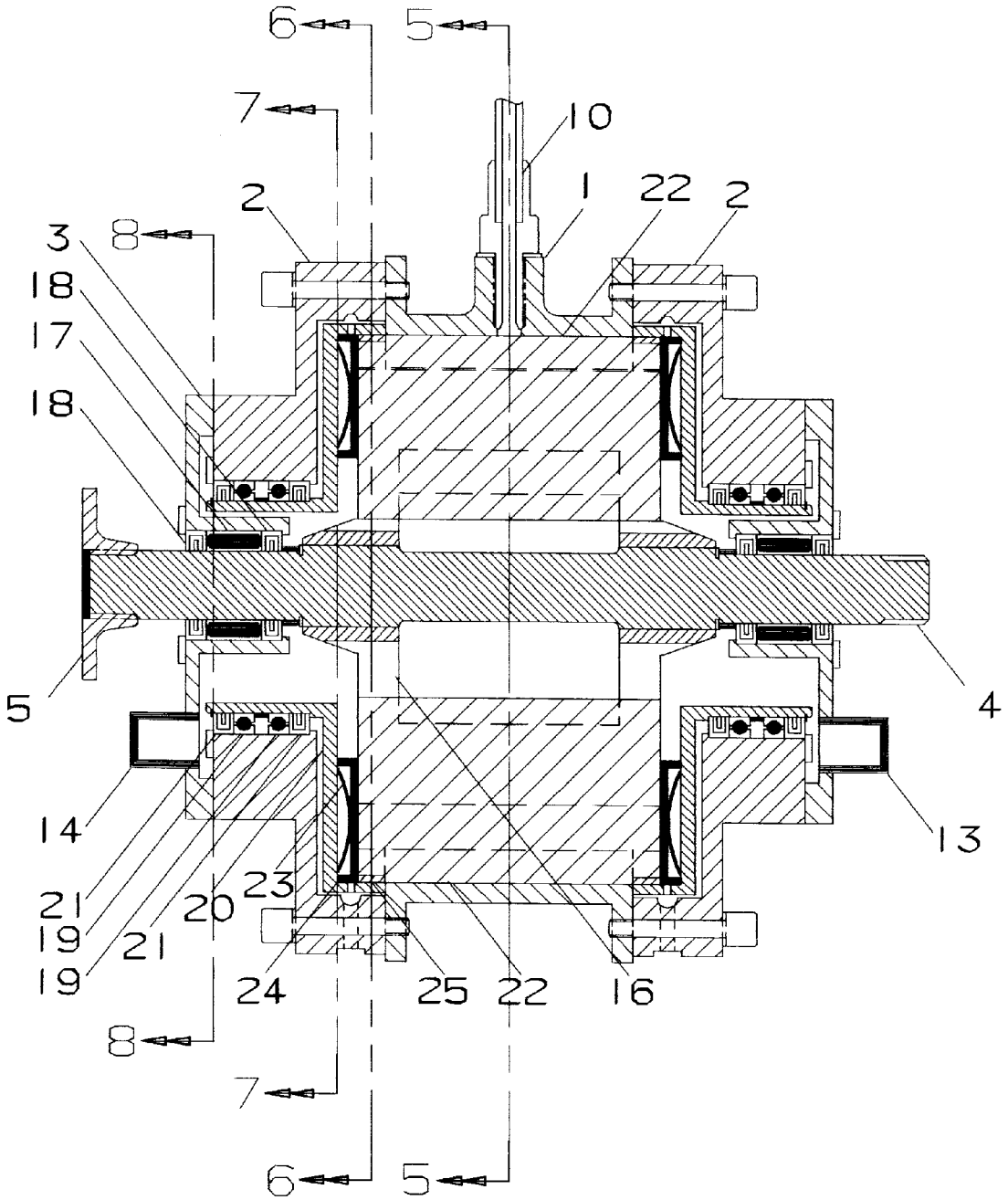
FIG. 4 is a sectional elevation which illustrates the internal general assembly along the longitudinal axis of rotation. Cross-section indicators define the axial location of each of the cross-section illustrations noted below.

The interior, axial, assembly is illustrated in FIG. 4. As shown in FIG. 4, the rotational shaft (4) extends throughout the length of the containment cylinder (1) and passes through the containment cylinder end structures (2). The longitudinal axis of the rotational shaft (4) is parallel to the longitudinal axis of the containment cylinder (1). A rotational armature with an axial cavity (16) is concentrically connected to the rotational shaft (4) such that the two components form an integrated rotational assembly. The rotational shaft (4) is supported by low-friction, rotational shaft support bearings (17). Rotational shaft support bearing oil seals (18) are installed on each side of each rotational shaft support bearing (17). Each containment cylinder end structure (2) accommodates a low-friction radial vane end support disc bearing (19) which radially and axially supports a rotating radial vane end support disc (20). Radial vane end support disc bearing oil seals (21) are installed on each side of each radial vane end support disc bearing (19). Each radial vane end support disc (20) features an annular flange on the rim of its inside face. An annular axial compression spring (23) and a wear ring (24) are installed on the inside face of the radial vane end support disc (20) and are radially constrained by the rim flange on the said radial vane end support disc. The wear rings (24), through compression of the annular axial springs (23), axially constrain the rotational armature (16) and the radial vanes (22). The peripheral flange on each of the radial vane end support discs (20) also radially constrains the radial vanes (22) such as to preclude contact between the radial vanes (22) and the inside surface of the containment cylinder (1). FIG. 2 shows the axial locations of the various cross section views of the engine. Note that for the purposes of this presentation, the internal assembly of the engine is axially symmetrical.

Figure 5:
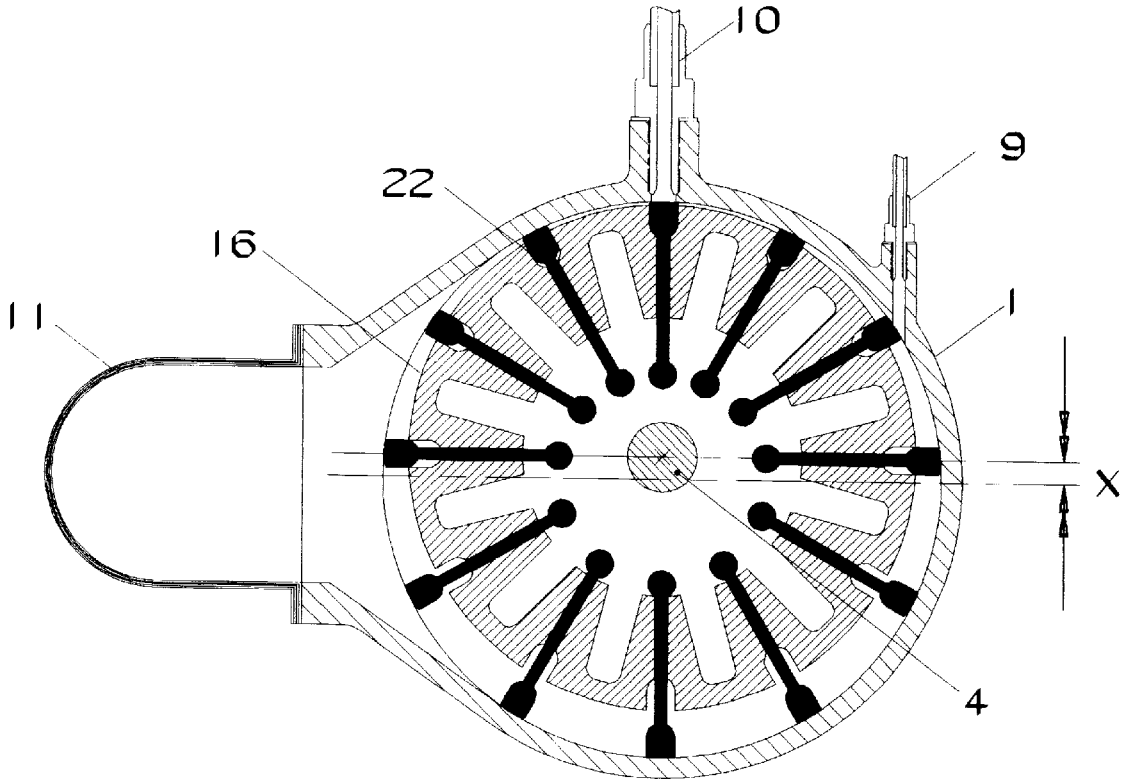
FIG. 5 is a cross section at approximately the mid-length of the assembly and shows the principal features of the rotational components and the arrangement of the ports for the admission and discharge of the working fluid.

As shown in FIG. 5 the rotational armature (16) incorporates a number of radial slots spaced equidistantly around the periphery. Each slot accommodates a radial vane (22). The longitudinal axis of the rotational shaft (4) is parallel to the longitudinal axis of the containment cylinder (1) but these axes are separated by the radial distance "X". FIG. 3 also shows the installation of the engine start injector (9), and the main injector (10), and the arrangements for porting the expanded working fluid through the wall of the containment cylinder to the exhaust manifold (11).

Figure 6:
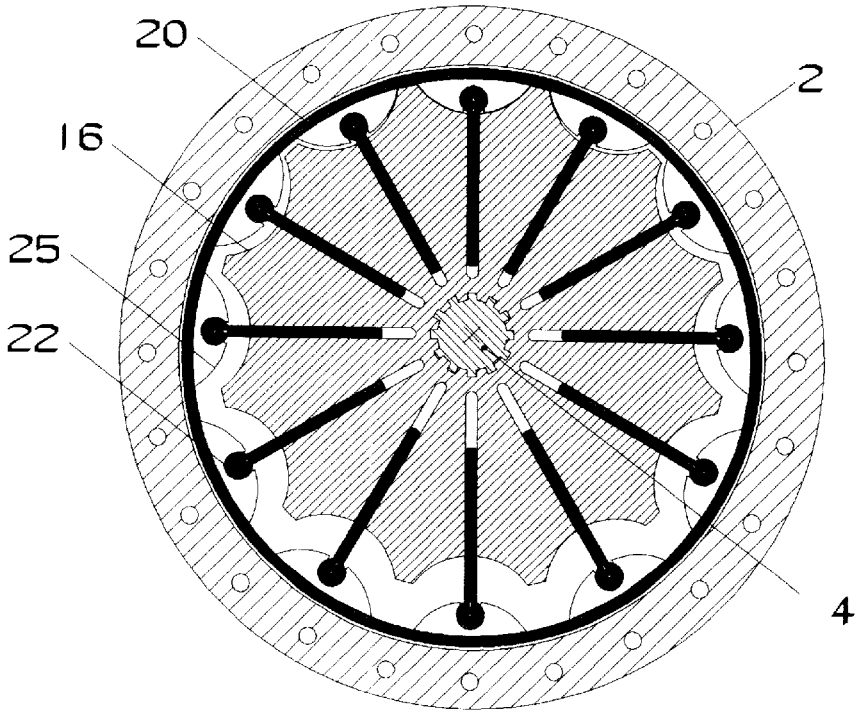
FIG. 6 is a cross section which illustrates the arrangements at the interface between the radial vanes and the radial vane end-support assembly.

FIG. 6 shows the arrangement by which each radial vane (22) is radially constrained by the peripheral flange of the radial vane end support disc (20). As shown in FIG. 4 each radial vane (22) is fitted with a bearing shoe (25) such as to allow partial relative rotation between the radial vane (22) and the bearing shoe (25). Each bearing shoe (25) maintains a bearing interface with the inside surface of the peripheral flange of the radial vane end support disc (20).

Figure 7:
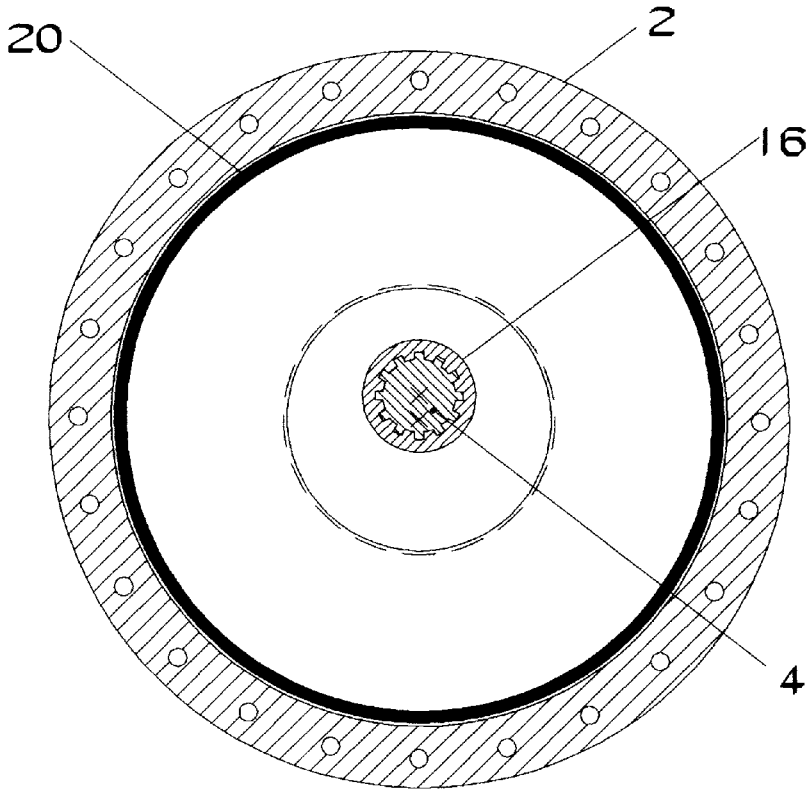
FIG. 7 is a cross section which shows the radial arrangement of the radial vane end-support assembly.

FIG. 7 and illustrates a cross section at the inside face of one wear ring (24) and shows the installation of the wear ring (24) within the peripheral flange of the radial vane end support disc (20) and the interface between the rotational shaft (4) and the rotational armature (16).

Figure 8:
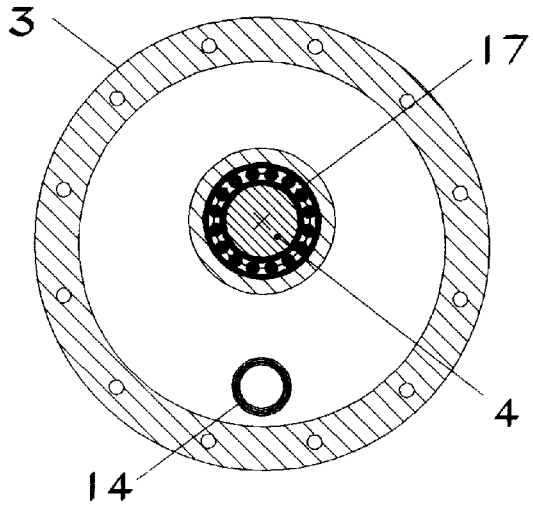
FIG. 8 is a cross section through one of the bearing carriers which accommodate the rotational shaft support bearings.

FIG. 8 illustrates the arrangement of the low-friction rotational shaft support bearings (17) and the internal vent discharge ports (14) in each of the containment cylinder end closure structures (2).

A typical radial vane (22) is shown in FIG. 9. In general, the radial vane (22) is a flat, rectangular, panel structure with a material concentration on the edge intended to approach the inside surface of the containment cylinder. As shown in FIG. 10, at each axial end the material concentration is cylindrically shaped to such as to provide a journal type interface with a bearing shoe (25). As shown in FIG. 11, between the cylindrical endings the material concentration accommodates a series of axial grooves to create a cascade type fluid seal and the radial vane edge intended to remain within the cavity of the rotational armature (16) may also increased in thickness to the extent necessary to provide axial rigidity.

I claim:

1. A vane type rotary device for manipulation of vaporous or gaseous fluids comprising:

a stationary structure consisting of a hollow containment cylinder with a circular bore and fitted with ports for supply and discharge of working fluid and end closures which hermetically isolate the interior of the said cylinder and provide structural support for the bearings of rotational assemblies;

a rotational shaft which supports a rotational armature and which, in turn is supported by low friction bearings installed in the ends of the stationary structure such that the axis of rotation is parallel to but separated from the axis of the bore of the containment cylinder;

a rotational armature with a partially hollow core and with a plurality of uniformly distributed radial slots which extend through the annulus and which are radial to the rotational axis of the armature;

an assembly consisting of plurality of vanes or blades which are axially integrated with the slots in the rotational armature such as to extend radially through and be supported by sliding contact with the annulus of the rotational armature;

a pair of vane constraint disks each of which has an outside diameter approximately equal to but less than the inside diameter of the containment cylinder and each of which is installed with an extended rim such as contain an axial compression spring and wear ring and to radially engage the ends of the plurality of radial vanes when collectively assembled within the containment structure;

a pair of low friction bearings one of which is installed in each containment structure end closure and arranged such as to support the radial vane constraining disks on a single axis of rotation which is concentric with the axis of the bore of the containment cylinder;

a pair of wear rings each of which is approximately equal to but less than the inside diameter of the axially extended rim of the radial constraint disk, one of said wear rings is installed in each of the radial constraint disks such as to present a flat, continuous, bearing and hermetically sealing surface to the axial ends of the rotating armature and the plurality of axial vanes; and a pair of axial compression springs which are approximately equal to but less than the inside diameter of the axially extended rim of the radial constraint disk one of said springs is installed in each of the radial constraint disks such as to provide the mechanical axial force necessary to maintain contact between the bearing surface of the wear ring and the axial ends of the rotating armature and the plurality of axial vanes.

* * * * *